US007721636B2

(12) United States Patent
Liu

(10) Patent No.: US 7,721,636 B2
(45) Date of Patent: May 25, 2010

(54) HOLE PUNCHER

(75) Inventor: I-Hui Liu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 223 days.

(21) Appl. No.: 11/812,406

(22) Filed: Jun. 19, 2007

(65) Prior Publication Data

US 2008/0314219 A1 Dec. 25, 2008

(51) Int. Cl.
*B26F 1/14* (2006.01)

(52) U.S. Cl. ..... 83/632; 83/633; 83/687

(58) Field of Classification Search ..... 83/687, 83/691, 625, 626, 632, 633
See application file for complete search history.

(56) References Cited

U.S. PATENT DOCUMENTS 332,666 A * 12/1885 Laney ..... 83/165
1,146,089 A * 7/1915 Neely ..... 83/625
3,726,170 A * 4/1973 Von Hofen ..... 83/556
3,817,139 A * 6/1974 Desai et al. ..... 83/617
4,166,404 A * 9/1979 Almog ..... 83/167
5,778,750 A * 7/1998 Drzewiecki et al. ..... 83/628
5,787,783 A * 8/1998 Evans et al. ..... 83/618
6,997,092 B2 * 2/2006 Lin ..... 83/588
D592,250 S * 5/2009 Cunningham et al. ..... D19/72
2007/0266836 A1 * 11/2007 Marks ..... 83/684

* cited by examiner

*Primary Examiner*—Kenneth E. Peterson
(74) *Attorney, Agent, or Firm*—Bacon & Thomas, PLLC

(57) ABSTRACT

A hole puncher has a base, multiple cutter brackets, multiple cutters, multiple springs, a linkage, an activating member and a handle. The base has two ends. The cutter brackets are mounted on the base. The cutters are mounted slidably through the cutter brackets. The linkage connects pivotally to one end of the base. The activating member connects pivotally to the linkage. The handle connects pivotally to the other end of the base and selectively pivots the linkage down. With the linkage and the activating member, the hole punch is effort-saving.

10 Claims, 7 Drawing Sheets

HOLE PUNCHER

BACKGROUND OF THE INVENTION

1. Field of the Invention

The present invention relates to a puncher, and more particularly to a hole puncher that saves a user's effort when the user employs the hole puncher to punch holes through paper sheets.

2. Description of Related Art

A conventional hole puncher comprises has a base, a handle, an articulated assembly and multiple cutters. The articulated assembly is connected pivotally to the base and the handle. The cutters are connected to the articulated assembly and are mounted slidably in the base. When the handle is pushed down, the cutters are driven down to cut paper sheets that extend into the base.

U.S. Pat. No. 5,163,350 entitled at "paper sheets punching apparatus" has a complicated structure therefore the cost of the punching apparatus is high.

Another U.S. Pat. No. 6,032,566 entitled at "lever operated punch with strengthened flap and punch head adjustment arrangement" has an improved effort-saving design allowing a user to easily operate the punch without much strenuous effort. However, the effort-saving effect is limited.

To overcome the shortcomings, the present invention provides a hole puncher to mitigate or obviate the aforementioned problems.

SUMMARY OF THE INVENTION

The main objective of the invention is to provide a hole puncher that saves a user's effort when the user employs the hole puncher to punch holes through paper sheets.

A hole puncher comprises a base, multiple cutter brackets, multiple cutters, multiple springs, a linkage, an activating member and a handle. The base has two ends. The cutter brackets are mounted on the base. The cutters (7) are mounted slidably through the cutter brackets. The linkage connects pivotally to one end of the base. The activating member connects pivotally to the linkage. The handle connects pivotally to the other end of the base and selectively pivots the linkage down. With the linkage and the activating member, the hole punch is effort-saving.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
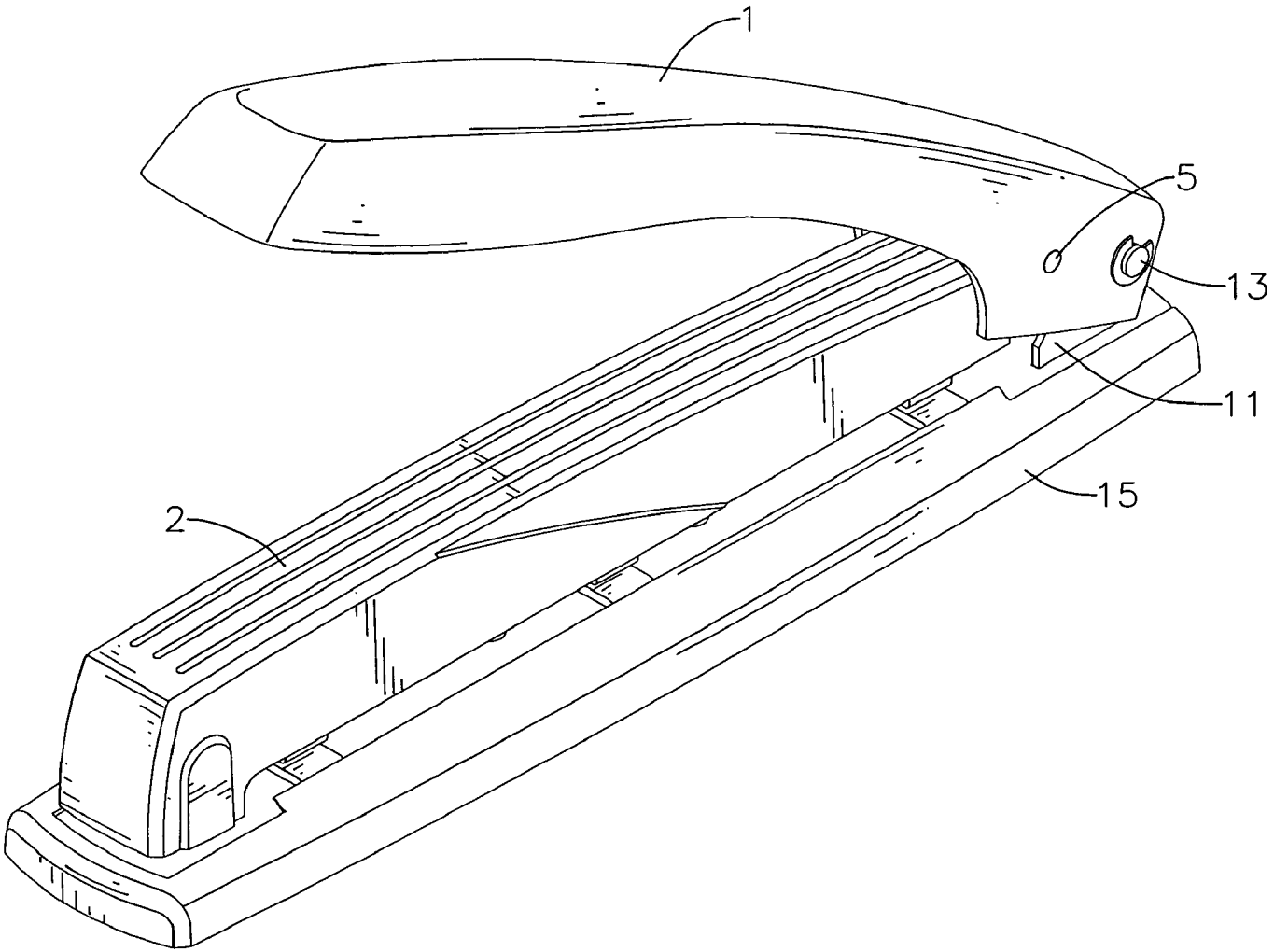
FIG. 1 is a perspective view of a first embodiment of a hole puncher in accordance with the present invention.

With reference to FIGS. 1, 5, 6 and 7, a hole puncher in accordance with the present invention comprises a base (10, 10B), multiple cutter brackets (9), multiple cutters (7), multiple springs (8), a linkage, an activating member (3) and a handle (1, 1C). The hole puncher may further comprise a lock device.

Figure 2:
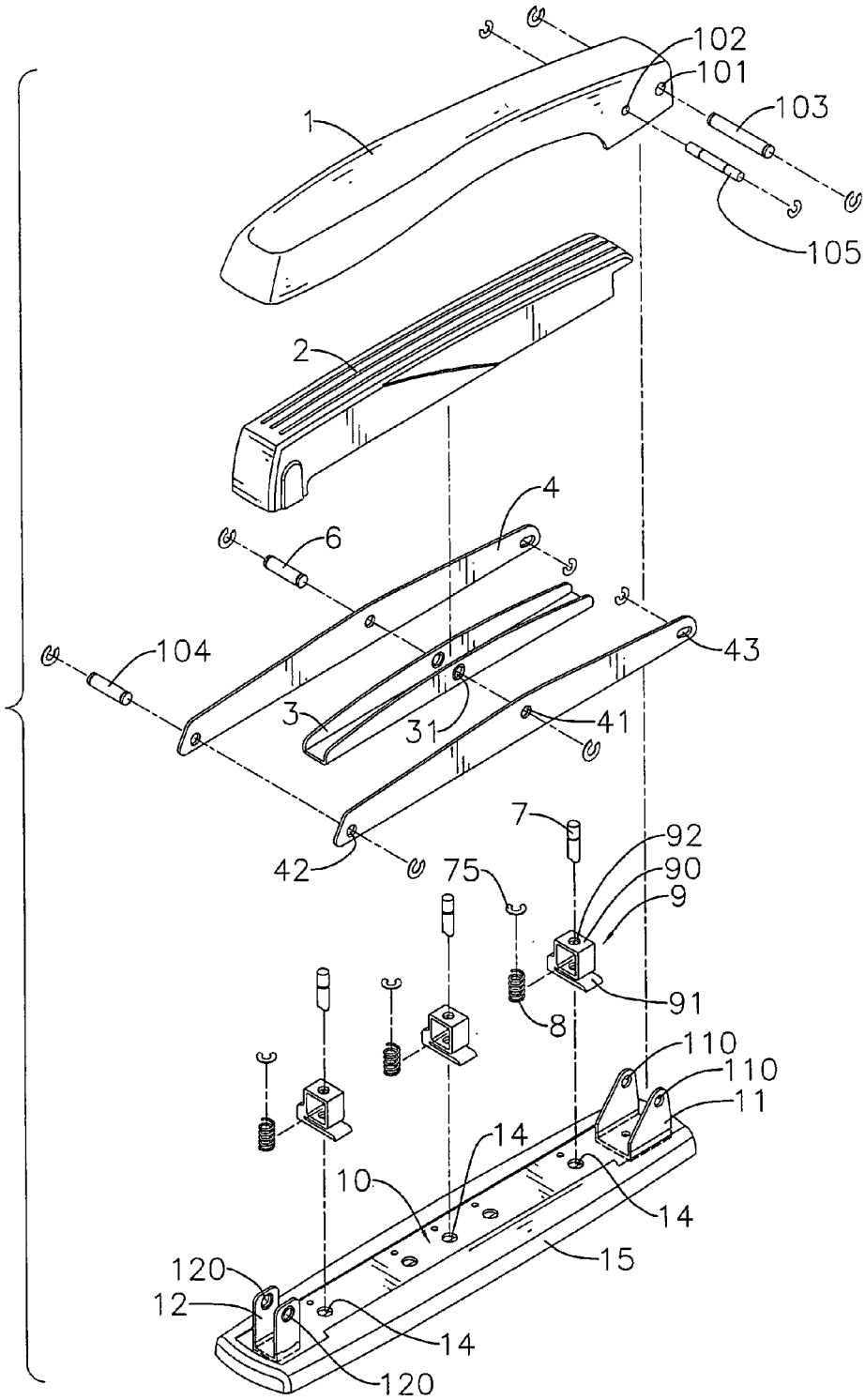
FIG. 2 is an exploded perspective view of the hole puncher in FIG. 1.
Figure 3:
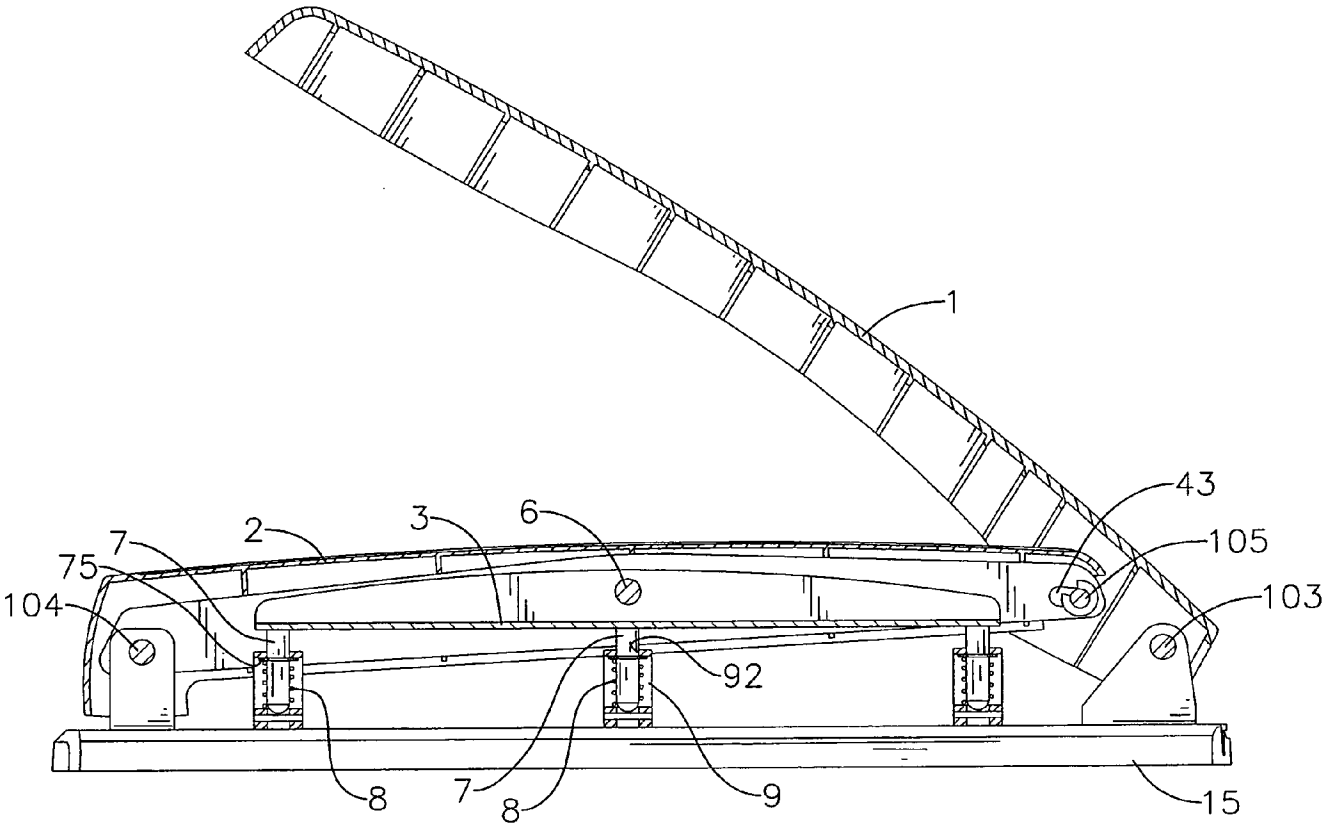
FIG. 3 is a side view in partial section of the hole puncher in FIG. 1.
Figure 4:
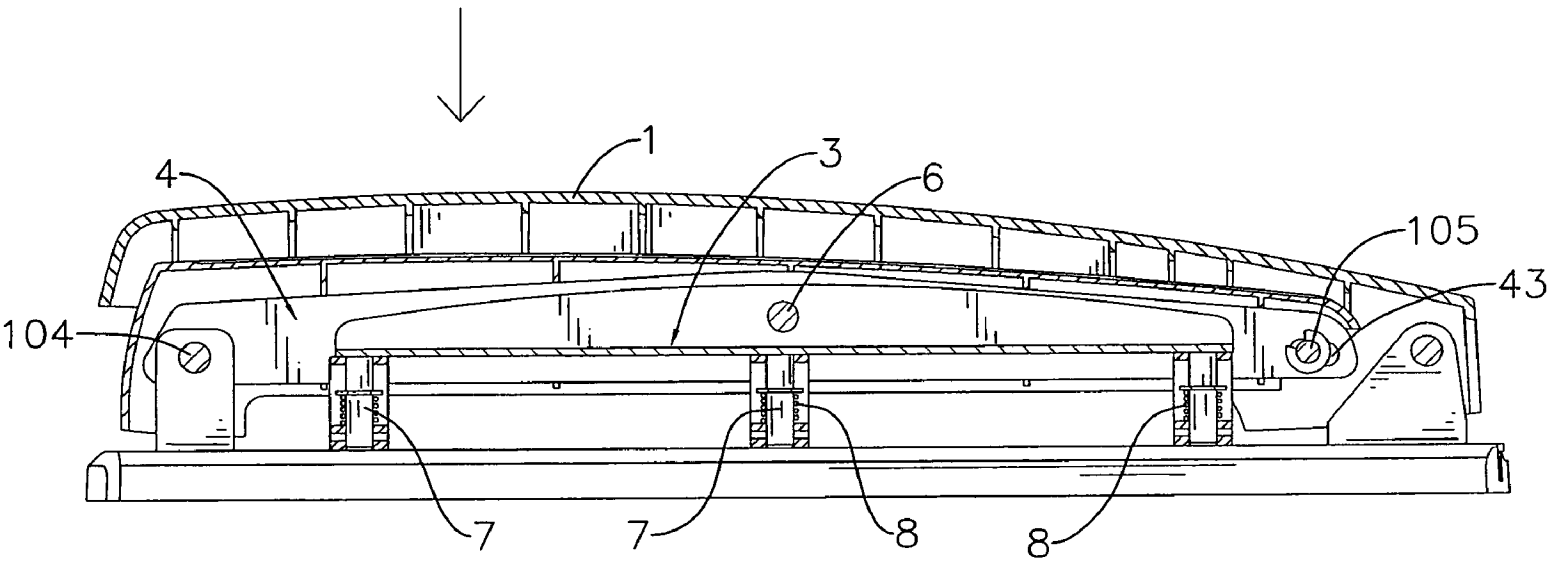
FIG. 4 is an operational side view in partial section of the multiple hole puncher in FIG. 3 with the handle pushed down.

With further reference to FIGS. 2 and 3, the base (10, 10B) has a front end, a rear end, a bottom surface, a top surface, multiple through holes (14), a linkage bracket (12, 12B) and a handle bracket (11, 11B) and may further have a bottom cover (15).

The through holes (14) are defined through the base (10, 10B) in a row.

The linkage bracket (12, 12B) is attached to the front end of the base (10, 10B) and may have two wings. Each wing has a pivot hole (120). In a first embodiment of the hole puncher, the linkage bracket (12) is U-shaped, is mounted on the bottom surface of the base (10) with the wings extending up through the base (10) out of the top surface. In a second embodiment of the hole puncher, the linkage bracket (12B) is formed integrally on the front end of the base (10B).

The handle bracket (11, 11B) is attached to the rear end of the base (10, 10B) and may have two wings. Each wing of the handle bracket (11, 11B) has a pivot hole (110). In the first embodiment, the handle bracket (11) is U-shaped, is mounted on the bottom surface of the base (10) with the wings extending up through the base (10) out of the top surface. In the second embodiment, the handle bracket (11B) is formed integrally on the rear end of the base (10B).

The bottom cover (15) is mounted on the bottom surface of the base (10, 10B) and serves as a scrape container to collect scrapes cut from paper sheets.

The cutter brackets (9) are hollow, are mounted on the base (10, 10B), correspond respectively to the through holes (14) and may receive a paper sheet. Each cutter bracket (9) may have a frame (90), a seat (91), a gap and has a guide hole (92).

The frame (90) is hollow and has an inner top surface and an inner bottom surface.

The seat (91) is formed on the frame (90) and is mounted on the base (10, 10B).

The gap is defined between the frame (90) and the seat (91) and may receive the paper sheet.

The guide hole (92) is defined through the cutter bracket (9), is aligned with a corresponding through hole (14) in the base (10, 10B) and may be defined through the frame (90) and the seat (91) and communicate with the gap.

The cutters (7) correspond respectively to the cutter brackets (9), are slidably mounted respectively through the guide holes (92) and each cutter (7) has a top end, a bottom end, a blade and a clasp (75). The blade is formed on the bottom end. The clasp (75) is mounted radially on the cutter (7), selectively abuts a corresponding cutter bracket (9) and may selectively abut the inner top surface of the frame (90) of the corresponding cutter bracket (9).

The springs (8) correspond respectively to and are mounted respectively in the cutter brackets (9), press respectively against the clasps (75) and respectively bias the cutters (7) up from extending completely through the cutter brackets (9). Preferably, each spring (8) is mounted in the frame (90) of a corresponding cutter bracket (9) and presses against the inner bottom surface of the frame (90) and the clasp (75) on the cutter (7) in the corresponding cutter bracket (9).

The linkage connects to the linkage bracket (12, 12B) on the base (10, 10B), has two links (4, 4A, 4B) and may further have a linkage pintle (104), an intermediate pintle (6), a connecting tab and a cover (2, 2C).

The links (4, 4A, 4B) are longitudinal, are arranged at an interval and connect pivotally to the linkage bracket (12, 12B) and each link (4, 4A, 4B) has a connecting end and a driven end opposite to the connecting end. Each link (4, 4A) may further have a longitudinal slot (43). The connecting end connects pivotally to the linkage bracket (12, 12B) and may have a pivot hole (42). In the first and second embodiments and a fourth embodiment, the longitudinal slot (43) of each link (4, 4A) is defined through the driven end.

The linkage pintle (104) extends through the pivot holes (120, 42) in the linkage bracket (12) and the links (4, 4A, 4B).

The intermediate pintle (6) is mounted between the links (4, 4A, 4B) and is located between the connecting ends and the driven ends.

Figure 6:
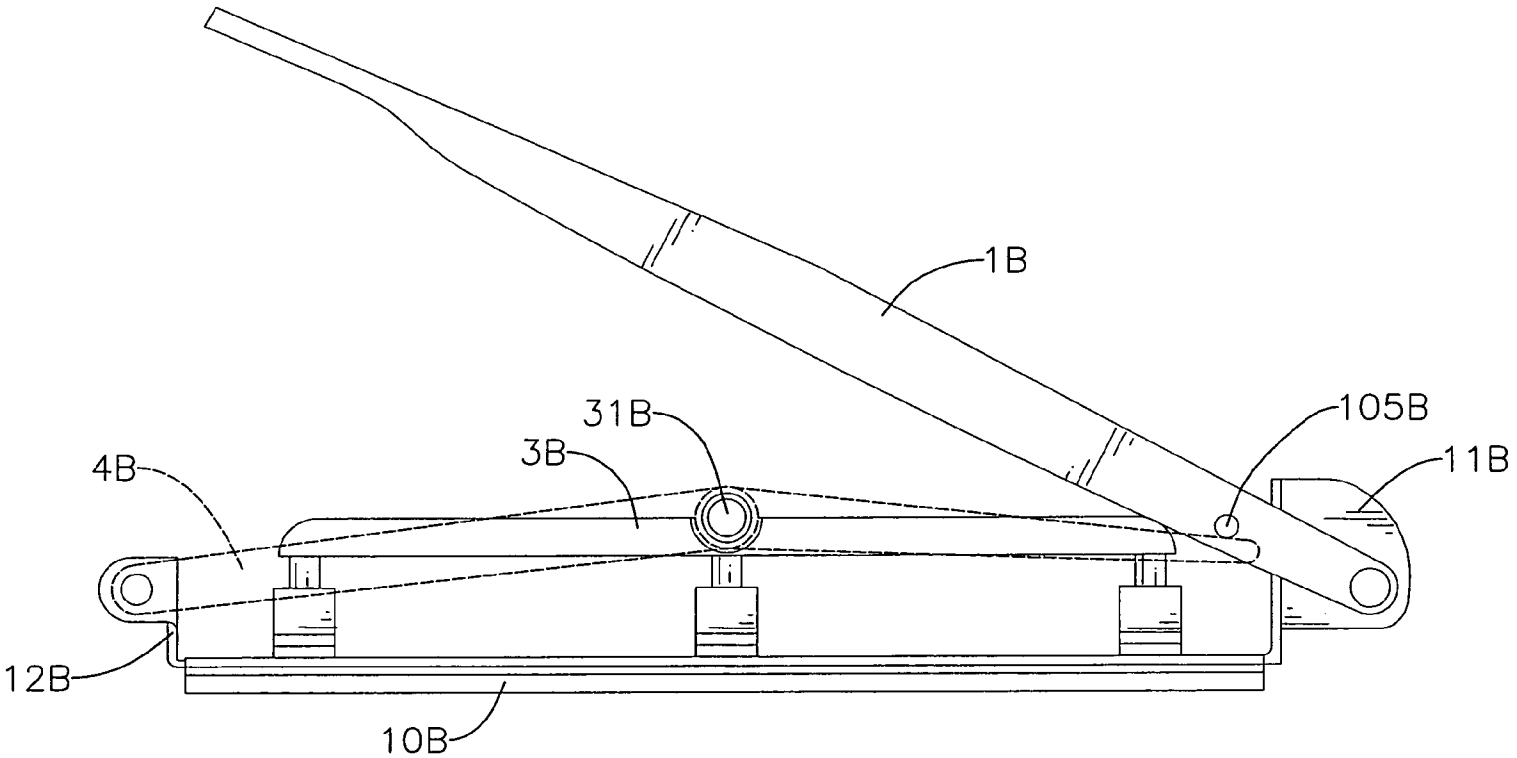
FIG. 6 is a side view of a third embodiment of a hole puncher in accordance with the present invention.
Figure 7:
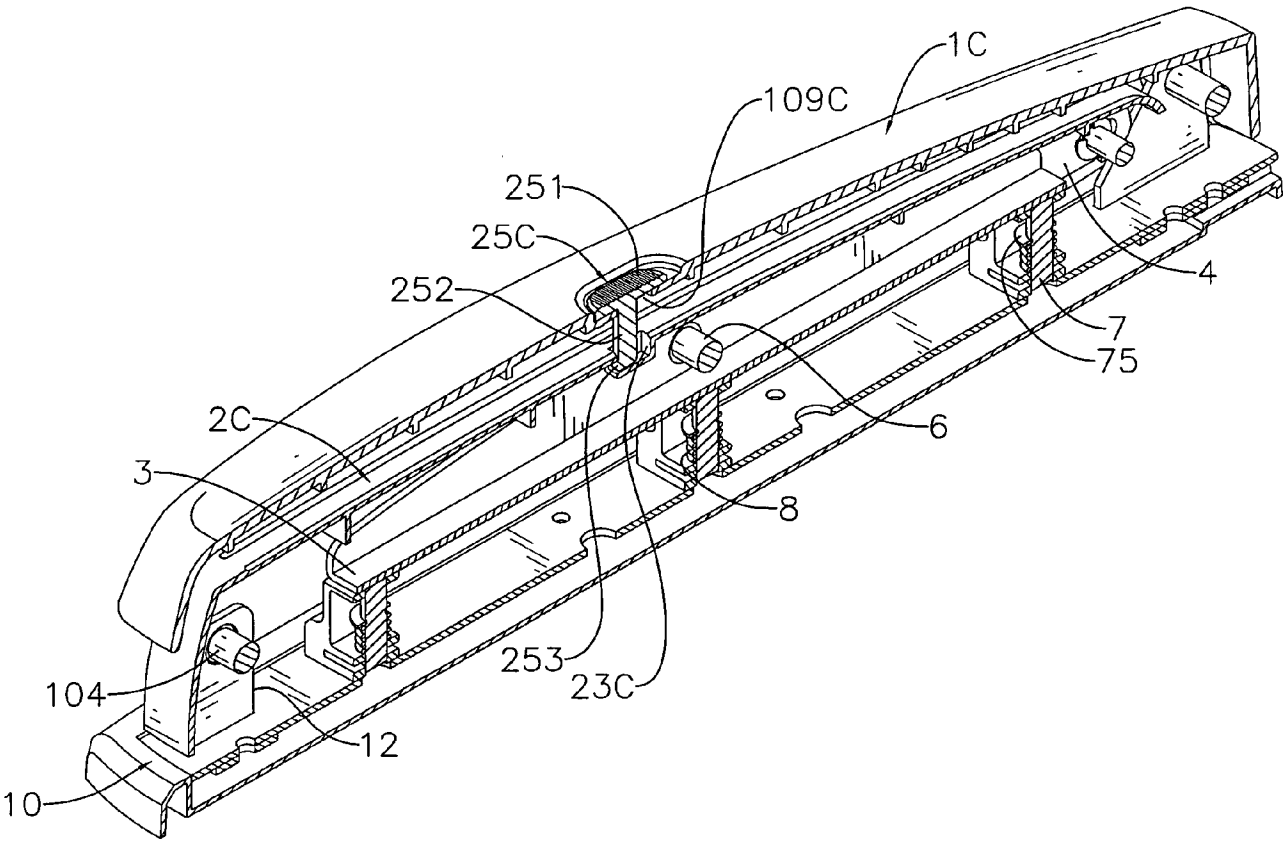
FIG. 7 is a cross sectional perspective view of a fourth embodiment of a hole puncher in accordance with the present invention.

In the first embodiment and third and fourth embodiments of the hole puncher, the links (4, 4B) are separate, as shown in FIGS. 2, 6 and 7.

Figure 5:
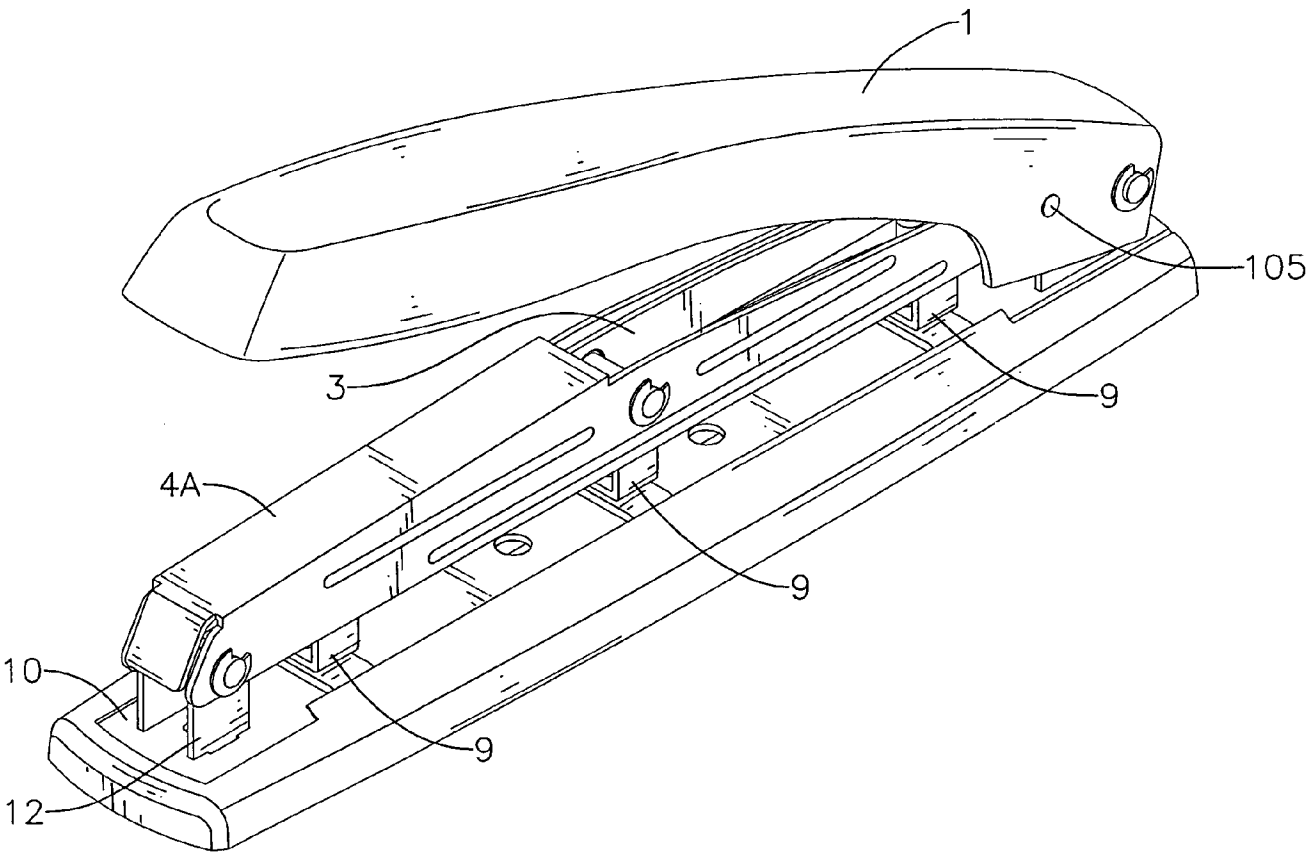
FIG. 5 is a perspective view of a second embodiment of a hole puncher in accordance with the present invention.

In the second embodiment, the connecting tab connects to and is formed integrally on the links (4A), as shown in FIG. 5. In the first and fourth embodiments, the cover (2, 2C) covers the links (4).

The activating member (3) connects pivotally to and is located between the links (4, 4A, 4B) of the linkage, may connect pivotally to the intermediate pintle (6) of the linkage and has a pressing member and an intermediate connecting member (31, 31B).

The pressing member is flat and abuts the top ends of the cutters (7). When the linkage driven to pivot down, the activating member (3) moves down and the pushing board presses the cutters (7) to moves down to cut through paper sheets.

The intermediate connecting member (31, 31B) is formed on the activating member (3), connects pivotally to the links (4, 4A, 4B) and may connect pivotally to the intermediate pintle (6). In the first, second and fourth embodiments, the intermediate connecting member (31) is a pivot hole through which the intermediate pintle (6) extends. In the third embodiment, the intermediate connecting member (31B) is a semicircular recess with which the intermediate pintle (6) engages rotatably, as shown in FIG. 6.

The handle (1, 1C) connects pivotally to the handle bracket (11, 11B) on the base (10, 10B) and selectively drives the driven ends of the links (4, 4A, 4B) of the linkage to pivot down to lower the activating member (3) to push the cutters (7) down. The handle (1, 1C) has a connection end, a push end and a driving member (105, 105B) and may further have a handle pintle (103).

The connection end connects pivotally to the handle bracket (11, 11B) and may further have a pivot hole (101).

The handle pintle (103) extends through the pivot holes (101, 110) of the handle (1, 1C) and the handle bracket (11, 11B).

The push end is opposite to the connection end and may be pushed by a user.

The driving member (105, 105B) is mounted on the handle (1, 1C) near the connection end and connects to and selectively drives the driven ends of the links (4, 4A, 4B) of the linkage to pivot down. In the first, second and fourth embodiments, the driving member (105) extends rotatably and slidably through the longitudinal slots (43) in the links (4, 4A) of the linkage. In the third embodiment, the driving member (105B) slidably and rotatably abuts the driven ends of the links (4B).

With reference to FIG. 7, the lock device in the fourth embodiment is mounted between the cover (2C) of the linkage and the handle (1C) and has a locking hole (23C), a mounting slot (109C) and a slide switch (25C). The locking hole (23C) is defined in the cover (2C) and has an inner surface. The mounting slot (109C) is defined through the handle (1C). The slide switch (25C) is mounted slidably through the mounting slot (109C), selectively locks the handle (1C) on the cover (2C) and has a slide tab (251), a strip (252) and a hook (253). The slide tab (251) is mounted slidably on the handle (1C). The strip (252) is formed on and protrudes perpendicularly from the slide tab (251) and has a distal end extending in the locking hole (23). The hook (253) is formed on the distal end and selectively hooks the inner surface of the locking hole (23) to lock and prevent the handle (1C) from pivoting inadvertently.

When the user pushes the push end of the handle (1, 1C) with a force, a torque arm for the force from the push end to the handle pintle (103) is much larger than an anti-torque arm for a reacting force from the handle pintle (103) to the driving member (105, 105B). The user saves effort when driving the linkage down. Furthermore, another torque arm for a stress from the driving member (105, 105B) to the linkage pintle (104) is twice as long as another anti-torque arm for a reacting stress from the linkage pintle (104) to the intermediate pintle (6). Therefore, the user further saves effort when driving the cutters (7) down. Accordingly, the hoe puncher is effort-saving and is convenient for people to use.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hole puncher comprising:

a base having a front end;

a rear end;

a bottom surface;

a top surface;

multiple through holes defined through the base in a row;

a linkage bracket attached to the front end of the base; and a handle bracket attached to the rear end of the base;

multiple cutter brackets being hollow, mounted on the base and corresponding respectively to the through holes and each cutter brackets having a guide hole defined through the cutter bracket and aligned with a corresponding through hole in the base;

multiple cutters corresponding respectively to the cutter brackets, slidably mounted respectively through the guide holes and each cutter having a top end;

a bottom end;

a blade formed on the bottom end; and a clasp mounted radially on the cutter and selectively abutting a corresponding cutter bracket;

multiple springs corresponding respectively to and mounted respectively in the cutter brackets, pressing respectively against the clasps and respectively biasing the cutters up from extending completely through the cutter brackets;

a linkage connecting to the linkage bracket on the base and having two links being longitudinal, arranged at an interval and connecting pivotally to the linkage bracket, and each link having a connecting end connecting pivotally to the linkage bracket; and a driven end opposite to the connecting end;

an activating member connecting pivotally to and located between the links of the linkage and having a pressing member being flat and slidably abutting the top ends of the cutters; and an intermediate connecting member formed on the activating member and connecting pivotally and non-slidably to the links; and a handle connecting pivotally to the handle bracket on the base and selectively driving the driven ends of the links to pivot down and having a connection end connecting pivotally to the handle bracket;

a push end being opposite to the connection end; and a driving member mounted on the handle near the connection end and connecting to and selectively driving the driven end of the links to pivot down.

2. The hole puncher as claimed in claim 1, wherein the linkage further has a cover covering the links.

3. The hole puncher as claimed in claim 2, wherein:

each link further has a longitudinal slot defined through the driven end;

the driving member extends rotatably and slidably through the longitudinal slots in the links.

4. The hole puncher as claimed in claim 1, wherein the driving member slidably and rotatably abuts the driven ends of the links.

5. The hole puncher as claimed in claim 3, wherein:

the linkage bracket is U-shaped, has two wings and is mounted on the bottom surface of the base with the wings extending up through the base out of the top surface; and the handle bracket is U-shaped, has two wings and is mounted on the bottom surface of the base with the wings of the handle bracket extending up through the base out of the top surface.

6. The hole puncher as claimed in claim 4, wherein the linkage bracket is formed integrally on the front end of the base, and the handle bracket is formed integrally on the rear end of the base.

7. The hole puncher as claimed in claim 3 further comprising a lock device mounted between the cover of the linkage and the handle and having a locking hole defined in the cover and having an inner surface;

a mounting slot defined through the handle; and a slide switch mounted slidably through the mounting slot, selectively locking the handle on the cover and having a slide tab mounted slidably on the handle;

a strip formed on and protruding perpendicularly from the slide tab and having a distal end extending into the locking hole; and a hook formed on the distal end and selectively hooking the inner surface of the locking hole.

8. The hole puncher as claimed in claim 3, wherein:

each cutter bracket further has a frame being hollow and having an inner top surface and an inner bottom surface;

a seat formed on the frame and mounted on the base; and a gap defined between the frame and the seat and adapted to receive a paper sheet;

the guide hole of each cutter bracket is defined through the frame and the seat and communicates with the gap of the cutter bracket; and each spring is mounted in the frame of a corresponding cutter bracket and presses against the inner bottom surface of the frame and the clasp on the cutter in the corresponding cutter bracket.

9. The hole puncher as claimed in claim 4, wherein:

the linkage further has an intermediate pintle mounted between the links and located between the connecting ends and the driven ends; and the intermediate connecting member is a semicircular recess with which the intermediate pintle engages rotatably.

10. The hole puncher as claimed in claim 1, wherein:

the activating member is U-shaped and has two side flanges extending from the pressing member, the intermediate connecting member is formed in the two side flanges, and an intermediate pintle passes through the intermediate connecting member in the two flanges and through holes formed in each of the two links to connect the activating member to the links.

* * * * *